US006159049A

United States Patent [19]

Schramme et al.

[11] Patent Number: 6,159,049

[45] Date of Patent: Dec. 12, 2000

[54] ELECTRICAL CONTACT AND BANDOLIER ASSEMBLY

[75] Inventors: Stephan H. Schramme, Farmington Hills, Mich.; Robert G. Plyler, Vienna, Ohio; Jerrold Scott Glynn, Northville, Mich.

[73] Assignee: Framatone Connectors Interlock, Inc., Westland, Mich.

[21] Appl. No.: 09/206,143

[22] Filed: Dec. 7, 1998

[51] Int. Cl.[7] ..... H01R 13/66

[52] U.S. Cl. ..... 439/620; 439/885

[58] Field of Search ..... 439/620, 885; 333/182, 185; 29/832; 206/713

[56] References Cited

U.S. PATENT DOCUMENTS 4,371,226 2/1983 Brancaleone ..... 439/620
4,804,332 2/1989 Pirc ..... 439/620
4,880,397 11/1989 Dawson, Jr. et al. ..... 439/620
5,286,221 2/1994 Fencl et al. ..... 439/607

*Primary Examiner*—Neil Abrams
*Attorney, Agent, or Firm*—Perman & Green, LLP

[57] ABSTRACT

An electrical connector having a housing that includes a conductive piece and a plastic piece, electrical contacts mounted to the housing, and a circuit assembly connected to the contacts. The circuit assembly comprises circuit elements and a lead frame. The lead frame is formed from a bandolier used to carry the contacts and the circuit elements prior to insertion into the housing. One portion of the lead frame may form a ground plane and may be joined to the conductive housing piece. Bandolier index holes may be used for attaching the ground plane portion to posts on the conductive housing piece. An uncut section of the lead frame may form a bridge for grounding a contact. The lead frame may also be mounted onto a ferrite block.

20 Claims, 8 Drawing Sheets

ELECTRICAL CONTACT AND BANDOLIER ASSEMBLY

BACKGROUND OF THE INVENTION

1. Field of the Invention

The present invention relates to electrical connectors and, more particularly, to a circuit assembly with a lead frame formed from a bandolier used to carry the contacts prior to insertion into the housing.

2. Prior Art

U.S. Pat. No. 5,286,221 discloses a filtered electrical connector assembly where pin contacts are temporarily retained on bandolier holders for inserting the pin contacts into the main connector. The connector has flexible capacitor filter circuits comprising chip capacitors mounted on flexible circuit members.

SUMMARY OF THE INVENTION

In accordance with one embodiment of the present invention an electrical contact and bandolier assembly is provided comprising electrical contacts and a bandolier. The contacts are attached to the bandolier. The bandolier is comprised of electrically conductive material with circuit element mounting areas adapted to have circuit elements mounted thereon. The bandolier carries the contacts prior to insertion into a housing to form an electrical connector. The bandolier also forms a lead frame between the contacts and the circuit elements as part of the electrical connector.

In accordance with another embodiment of the present invention an electrical connector is provided comprising a housing, electrical contacts mounted to the housing, and a circuit assembly connected to the contacts. The circuit assembly comprises a lead frame and circuit elements attached to the lead frame. The lead frame is formed from a bandolier used to carry the contacts prior to insertion into the housing.

In accordance with one method of the present invention a method of manufacturing a circuit assembly is provided comprising steps of connecting electrical contacts to a bandolier; and attaching electrical circuit elements directly on the bandolier. The bandolier forms a lead frame between the contacts and the circuit elements.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
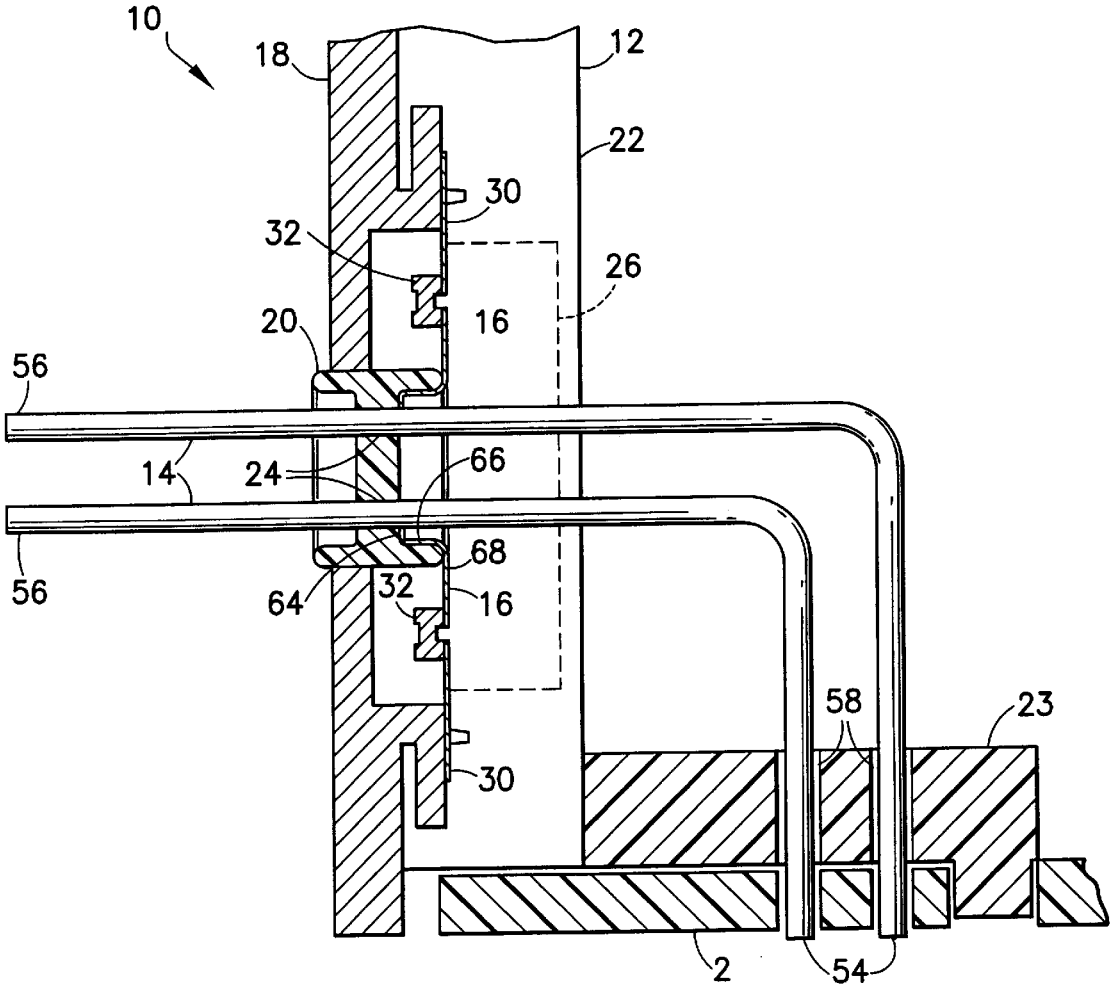
FIG. 1 is a cross-sectional view of an electrical connector incorporating features of the present invention attached to a printed circuit board.

Referring to FIG. 1, there is shown a cross-sectional view of an electrical connector 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The connector 10 generally comprises a housing 12, filtering circuit assemblies 16 and electrical contacts 14. In this embodiment the connector is a right angle connector adapted to be fixedly mounted to a printed circuit board 2 and have another mating connector (not shown) removably attached to the connector 10. However, in alternate embodiments the electrical connector need not be a right angle connector and could be adapted to be mounted to an electronic component other than a printed circuit board. The housing 12 generally comprises an electrically conductive housing piece 18, a plastic housing piece 20, and a plastic rear cover 22. The plastic housing piece 20 sits in a hole in the conductive housing piece 18 and has apertures 24 which the contacts 14 pass through. The plastic housing piece 20 is fixedly attached to the contacts 14 and conductive housing piece 18 to thereby fix the contacts 14 relative to conductive housing piece 18 and electrically insulate the contacts 14 from directly contacting the conductive housing piece 18. The rear cover 22 attaches to the rear side of the conductive housing piece 18 to enclose the filtering circuit assemblies 16 between the two pieces 18, 22. The cover 22 can have a receiving area 26 to accommodate a ferrite block (not shown) on the contacts 14 if desired.

Figure 2:
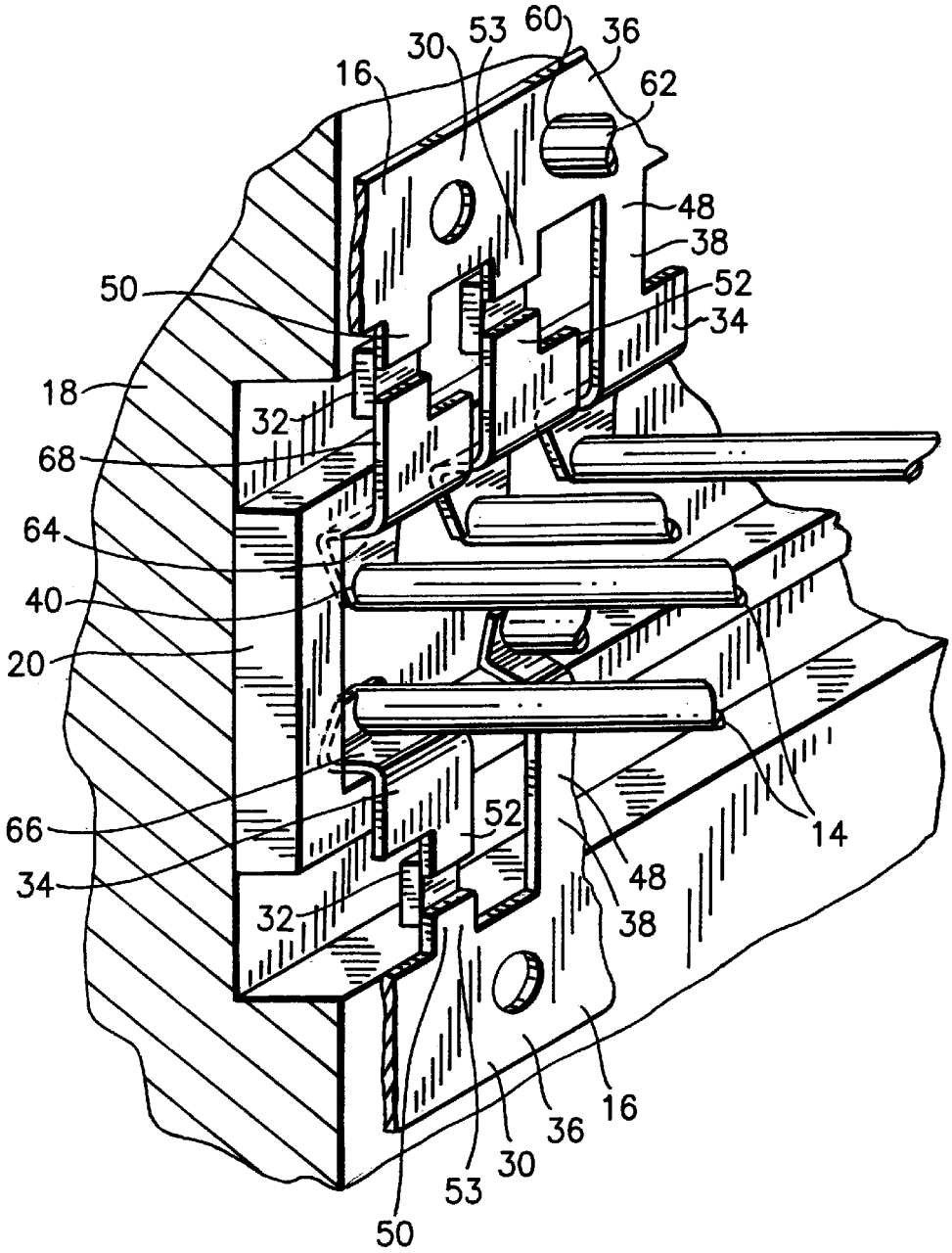
FIG. 2 is a partial rear perspective view of the connector shown in FIG. 1.

Referring also to FIG. 2 a partial rear end perspective and cut-away view of the connector is shown without the cover 22. In this embodiment the connector 10 has two of the filtering circuit assemblies 16. However, in alternate embodiments only one or more than two of the assemblies 16 could be provided. Each circuit assembly 16 generally comprises a lead frame 30 and circuit elements 32. The lead frame 30 is preferably comprised of stamped sheet metal as will be described in further detail below.

The circuit elements 32 are preferably surface mount soldered on the lead frames 30. Preferably, the circuit elements 32 are chip capacitors. The lead frames 30 have a first end 34, a second end 36, and a middle section 38 therebetween. The first end 34 has holes 40 which the contacts 14 pass through. The lead frames 30 make individual electrical contact with the contacts 14 at the holes 40. In this embodiment the first end 34 has a plurality of separate fingers; one for each contact 14. However, in an alternate embodiment a single first end finger section could contact more than one contact. In this embodiment the fingers of the first end 34 each have a first portion 64, a second portion 66, and a third portion 68. The first portion 64 has the hole 40 and extends generally perpendicular from its respective contact 14. The second portion 66 is bent relative to the first portion 64 to seat against a pocket of the plastic housing piece 20. The third portion 68 is bent relative to the second portion 66 to extend generally perpendicularly away from the contact 14. The second end 36 forms a ground plane for the assembly 16. The middle section 38, in this embodiment, has a bridging section 48 electrically and mechanically connecting the first and second ends 34, 36 and circuit element mounting areas 50. The bridging section 48 allows the ground plane of the second end 36 to be electrically connected to one of the contacts 14; this contact being a ground contact rather than a signal contact. In an alternate embodiment the lead frame 30 need not have bridging sections. The second ends 36 are electrically and mechanically connected to the conductive housing piece 18. In this embodiment holes 60 in the second ends 36 are mounted on posts 62 of the conductive housing piece 18. The mounting areas 50 each comprise two electrically separate surface mounting tabs 52, 53 directly opposite each other. The circuit elements 32 are surface mount soldered on pairs of the tabs 52, 53 to form electrical circuit paths from the first end 34, through the circuit elements 32, to the second end 36.

Figure 3:
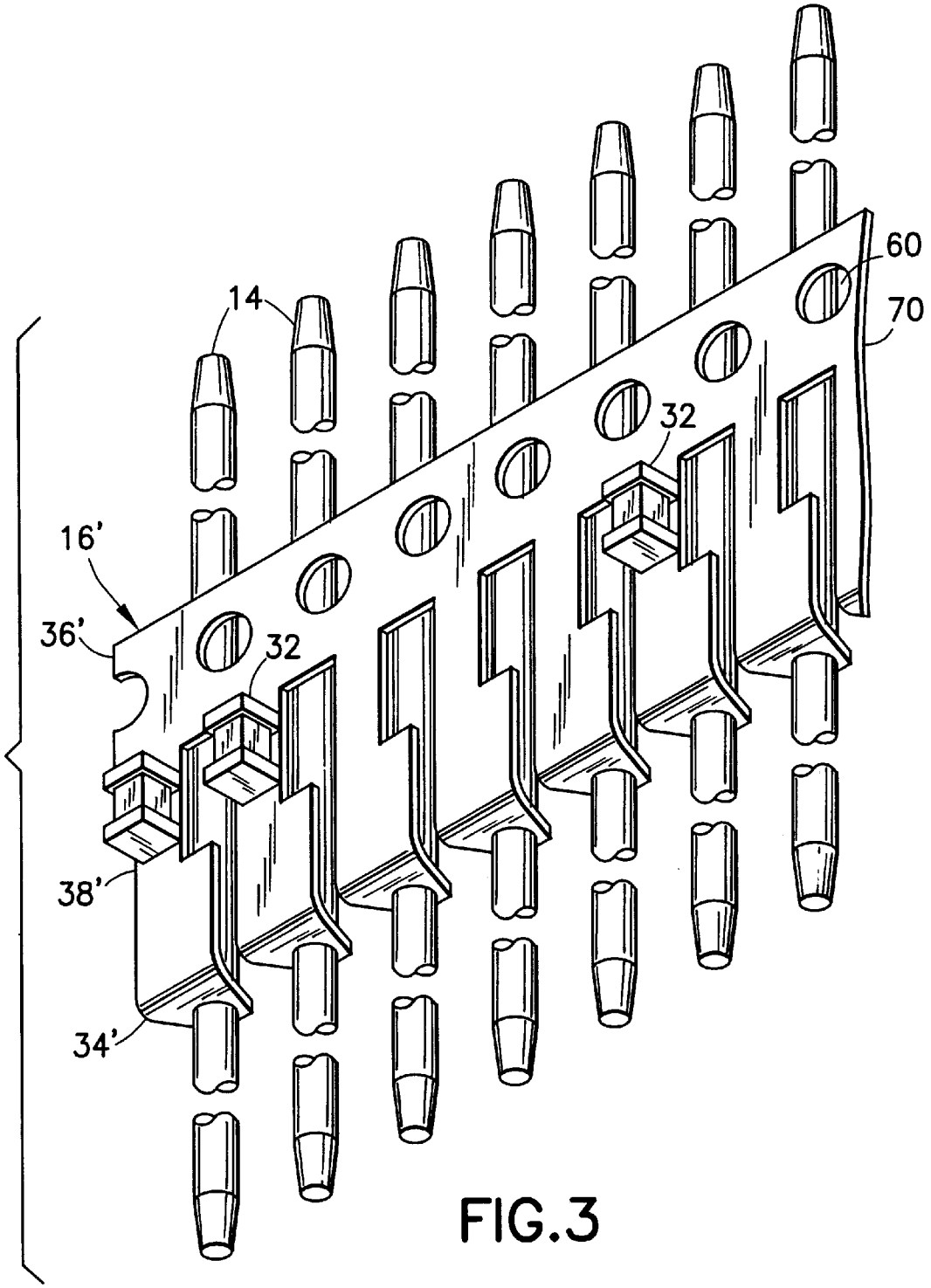
FIG. 3 is a partial perspective view of an electrical contact and bandolier circuit assembly used to form the connector shown in FIG. 1.
Figure 3A:
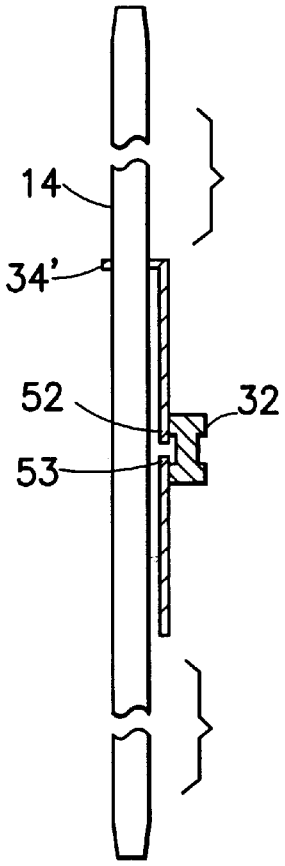
FIG. 3A is a cross-sectional view of the assembly shown in FIG. 3.
Figure 3B:
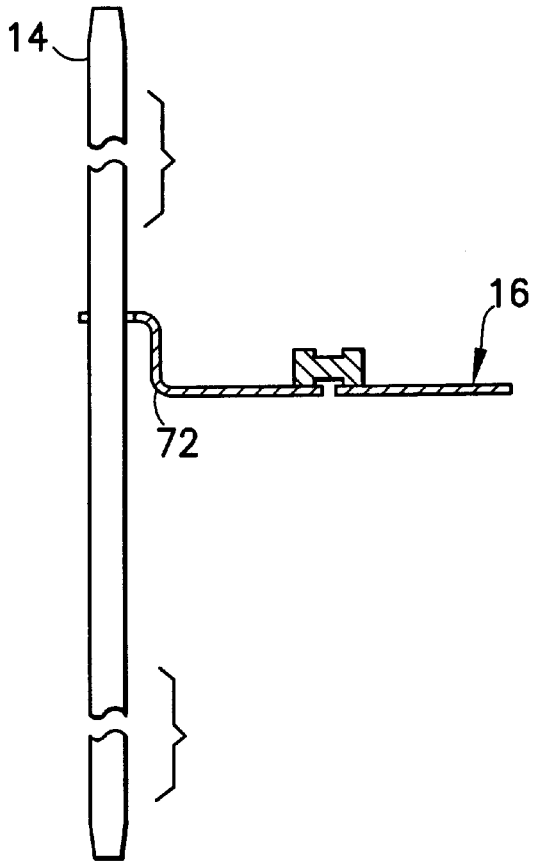
FIG. 3B is a cross-sectional view as in FIG. 3A with the lead frame bent at a right angle to the electrical contact.

Referring now to FIG. 3, a partial perspective view of a subassembly of electrical contacts 14 and a bandolier circuit assembly 16' is shown which is used to form the connector 10. The bandolier circuit assembly 16' generally comprises a bandolier 70 and the circuit elements 32. The bandolier 70 is comprised of sheet metal. The bandolier 70 comprises a first end 34' which forms the first end 34 of the lead frame, a second end 36' which forms the second end 36 of the lead frame, and a middle section 38' which forms the middle section 38 of the lead frame. The contacts 14 are attached to the bandolier 70 at the first end 34'. The bandolier 70, before the contacts 14 are inserted into the housing 12, functions as a structural member to locate, retain, and carry the contacts 14. The contacts 14 are preferably connected to the bandolier 70 prior to the circuit elements 32 being connected to the bandolier 70. The second end 36' has the holes 60 which function as indexing holes to move sheet metal stock which forms the bandolier through a progressive die forming apparatus that cuts, stamps and forms the sheet metal stock into the shape shown. As noted above, the holes 60 are also used to attach the second end 36 to the housing piece 18. However, alternative or addition connection means could be provided. The middle section 38' has not been cut yet to form the tabs 52, 53. The tabs 52, 53 can be formed after the circuit elements 32 are mounted to the bandolier 70 as shown in FIG. 3A. Alternatively, the bandolier can be cut to form the tabs 52, 53 before the circuit elements 32 are attached to the bandolier. In order to attach the circuit elements 32 to the bandolier 70 the circuit elements are preferably surface mount soldered to the bandolier. Just before the assembly 16 is to be inserted into the housing 12, the bandolier 70 is cut to form the lead frame with a predetermined number of the contacts 14 and bent at bend 72 as shown in FIG. 3B. The subassembly shown in FIG. 3B of the contacts 14 and filtering circuit assembly 16 is then connected to the housing 12.

Figure 4:
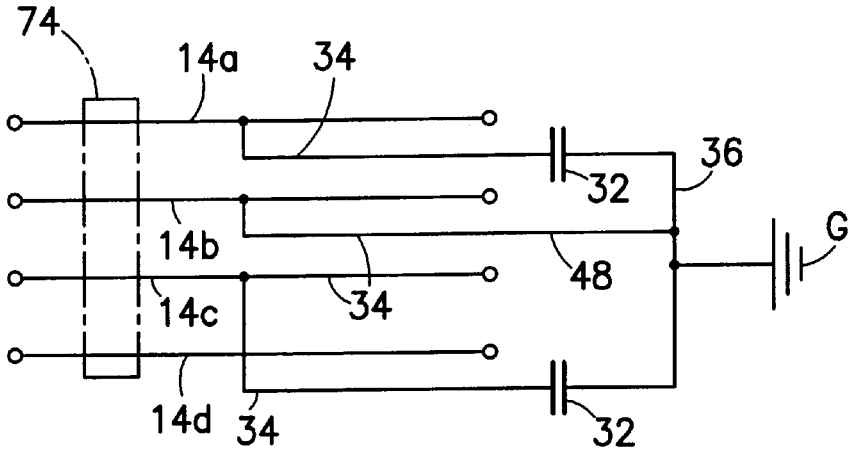
FIG. 4 is a partial circuit diagram of the electrical circuit formed by the electrical contacts and the lead frame and circuit element assembly.

FIG. 4 shows a partial circuit diagram of an electrical circuit which can be formed by the electrical contacts 14 and the assembly 16. The circuit can include a ferrite block 74 on the contacts 14. The second end 36 is connected to ground G. Pin 14*b* is a ground contact. Pins 14*a*, 14*c*, 14*d* are signal contacts filtered by capacitors 32.

Figure 5:
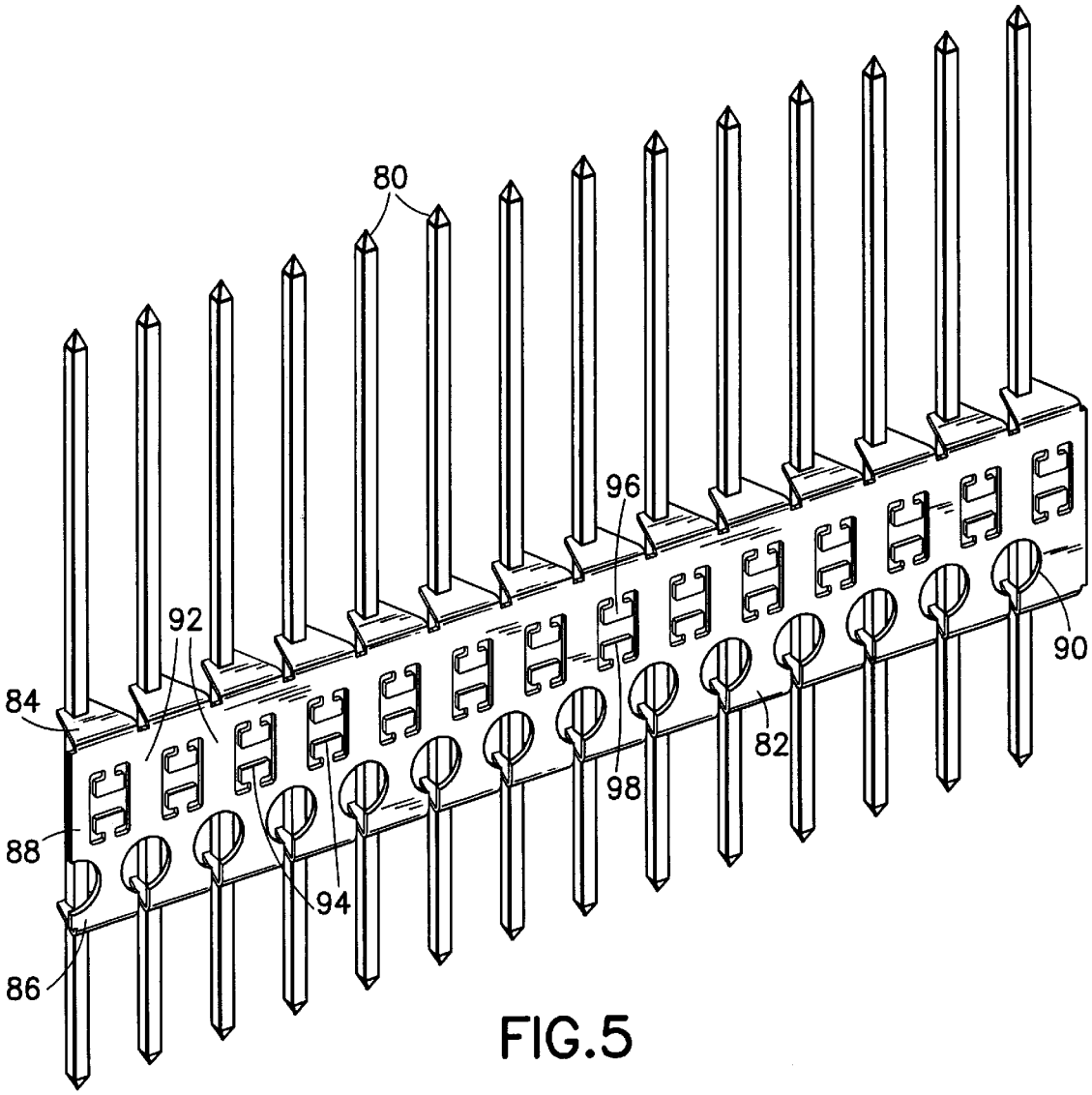
FIG. 5 is a perspective view of an alternate embodiment of an electrical contact and bandolier assembly for use in forming a filtering circuit subassembly.

Referring now to FIGS. 5–8 an alternate embodiment will be described. FIG. 5 is a perspective view of a set of electrical contacts 80 attached to a bandolier 82. The bandolier 82 has a first end 84, a middle section 88, and a second end 86. The first and second ends 84, 86 are attached to the contacts 80 and have bends to form a general c-shaped side profile for the bandolier. The second end 86 also has indexing holes 90 that are used to move the sheet metal through the progressive die forming apparatus (not shown) that stamps the bandolier into the shape chosen and are used to move the bandolier through a contact inserting stage that connects the contacts 80 with the bandolier. The middle section 88 comprises alternating structural bridging sections 92 and circuit element mounting areas 94. The bridging sections 92 connect the two ends 84, 86 to each other. The circuit element mounting areas 94 comprise opposing spaced tabs 96, 98. One tab 96 extends from the first end 84 and one tab 98 extends from the second end 86. The tabs 96, 98 are also spaced from the bridging sections 92.

Figure 6:
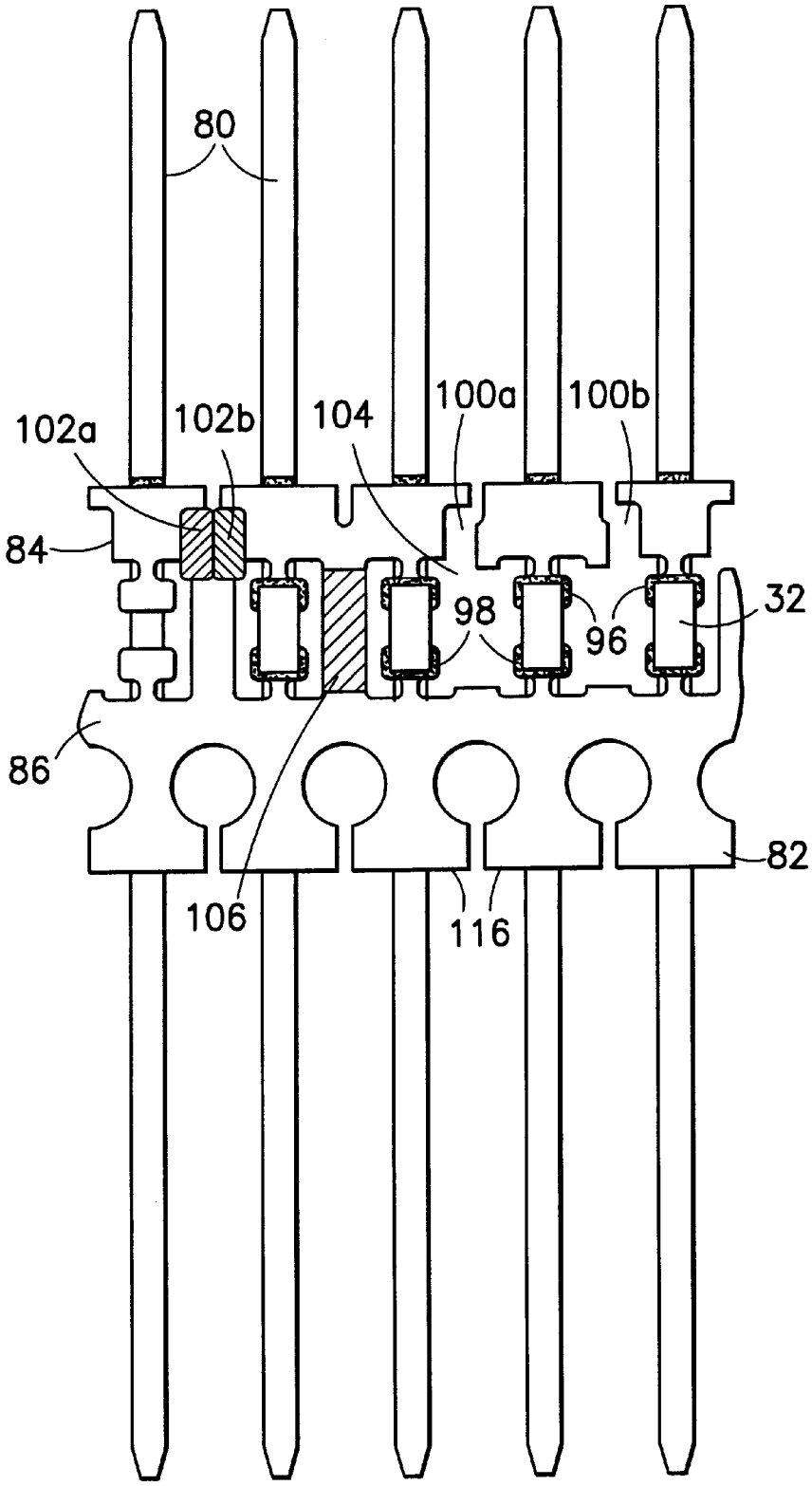
FIG. 6 is a partial elevational view of an electrical contact and bandolier circuit assembly made from the assembly shown in FIG. 5.

FIG. 6 shows a part of the bandolier circuit assembly and some of the electrical contacts manufactured from the electrical contact and bandolier assembly shown in FIG. 5. Selected ones of the tabs 96, 98 have the circuit elements 32 mounted thereon. Selected areas 100*a*, 100*b* of the first end 84 are cut out, such as by selective stamping by dies 102*a*, 102*b*, in a programmable progressive die forming apparatus. Likewise, area 104 of the middle section 88 can be stamped out by selective stamping die 106 of the programmable progressive die forming apparatus. Areas 100*a*, 100*b* and 104 are spaced between the contacts 80 and are therefore relatively easy to remove.

Figure 7:
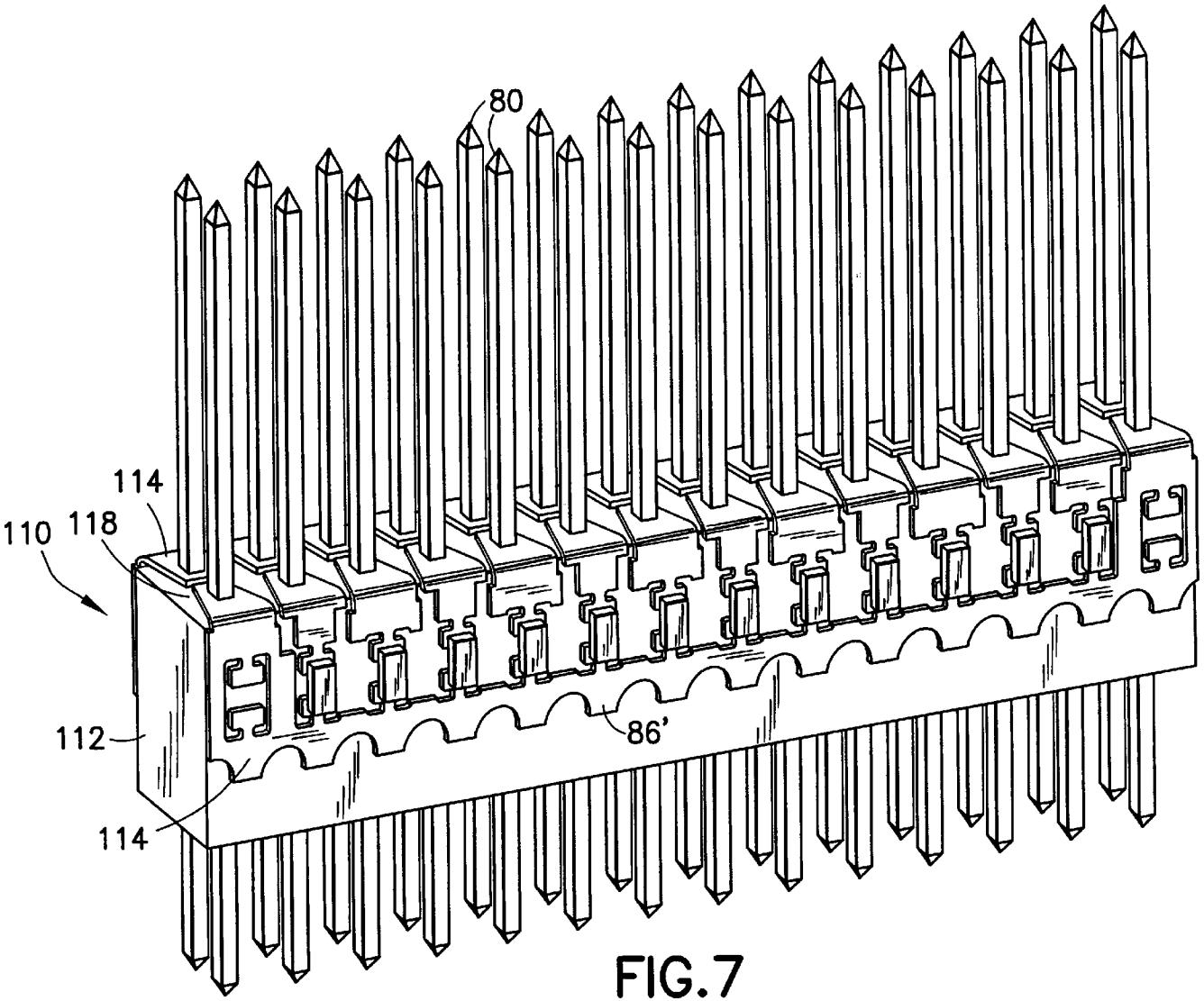
FIG. 7 is a perspective view of an alternate embodiment of a filtering circuit subassembly.

Referring also to FIG. 7, there is shown a perspective view of an electrical contact and filtering circuit subassembly 110 manufactured with the electrical contact and bandolier assembly shown in FIG. 6. The subassembly 110 comprises a ferrite block 112 and two electrical contact and filtering circuit assemblies 114. The ferrite block 112 has holes which the pin contacts 80 pass through. The assemblies 114 are formed from the bandolier circuit assembly shown in FIG. 6 wherein portions 116 of the second end 86 have been removed to form the new second end 86'. Thus, the bottom ends of the contacts 80 can be slid through the holes in the ferrite block 112 with the first end 84 coming to rest on the top side 118 of the ferrite block 112. The middle section 88 and second end 86' are positioned on the lateral sides of the block 112. Preferably, the ferrite block is comprised of electrically non-conductive ferrite oxide. However, electrically conductive ferrite oxide could be used if electrical insulators are used between the block 112 and the contacts, and between the block 112 and the assemblies 114.

Figure 8:
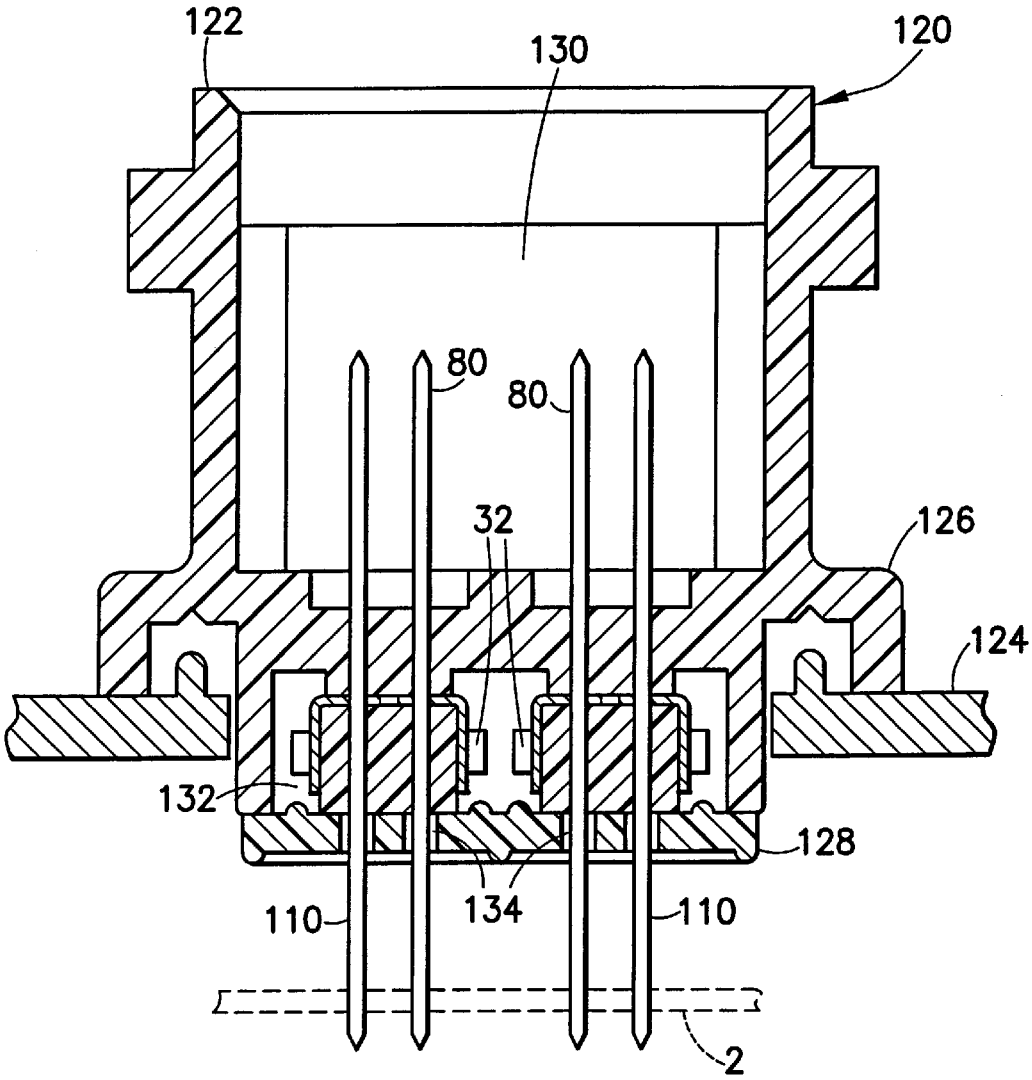
FIG. 8 is a cross-sectional view of part of an electrical connector having two of the filtering circuit subassemblies shown in FIG. 7.

Referring also to FIG. 8, an electrical connector 120 is shown which uses two of the subassemblies 110. Connectors can be provided which use only one or more than two of the subassemblies if desired. The connector 120 has a housing 122 with a cast aluminum member 124, a plastic header shroud 126, and a plastic end cap 128. However, in alternate embodiments other types of housings or housing components could be used. The housing 122 has an area 130 for receiving a portion of a mating electrical connector (not shown). The subassemblies 110 are fixedly attached to the housing on the plastic header shroud 126 by means of the contacts 80 being fixed to the shroud 126 and by means of the subassemblies 110 being captured in area 132 of the shroud 126 by the cap 128. Area 132 can be filled with encapsulant if desired. The bottom ends of the contacts 80 extend out holes 134 of the cap 128 for connection to a printed circuit board 2. The method of the present invention can also be used to manufacture a similar electrical connector shown in application Ser. No. 09/206,459, now U.S. Pat.

No. 6,086,422, filed the same date herewith which is hereby incorporated by reference.

The present invention provides multiple advantages. Because the contact bandolier is being used as a lead frame between the circuit elements 32 and the contacts, the bandolier is no longer being thrown away as in the prior art and there is no need to provide a separate lead frame, such as a flexible circuit as in the prior art. Thus, with the present invention manufacturing costs can be reduced. Assembly can also be made faster and simpler because there is no need for a separate lead frame component. The structural rigidity of the sheet metal used for the bandolier/lead frame can also be used as a retainer for the filtering circuit subassembly that could not be provided with the flexible circuit used in the prior art.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical contact and bandolier assembly comprising:

electrical contacts; and a bandolier having the contacts attached thereto, the bandolier being comprised of electrically conductive material with circuit element mounting areas adapted to have circuit elements mounted thereon, wherein the bandolier carries the contacts prior to insertion into a housing to form an electrical connector and the bandolier also forms a lead frame between the contacts and the circuit elements as part of the electrical connector.

2. An assembly as in claim 1 wherein the electrical contacts comprise male pins.

3. An assembly as in claim 1 wherein the bandolier has first end with connection sections attached to respective separate ones of the electrical contacts, a second end forming a ground plane, and a middle section located between the first and second ends having the circuit element mounting areas.

4. An assembly as in claim 3 wherein the second end has bandolier movement registration holes therethrough.

5. An assembly as in claim 3 wherein the middle section further comprises structural bridging sections between the first and second ends, at least some of the bridging sections intended to be cut to form the lead frame.

6. An assembly as in claim 3 wherein the circuit element mounting areas are adapted to be cut after the circuit elements are mounted thereon to establish a path between opposite ends of the mounting areas through the circuit elements.

7. An assembly as in claim 3 wherein the second end has connection sections attached to respective separate ones of the electrical contacts which are removed when the second end is formed into the ground plane.

8. An electrical connector comprising:

a housing;

electrical contacts mounted to the housing;

a circuit assembly connected to the contacts, the circuit assembly comprising a lead frame formed from a bandolier used to carry the contacts prior to insertion into the housing and circuit elements attached to the lead frame.

9. A connector as in claim 8 wherein the circuit elements comprise surface mounted chip capacitors.

10. A connector as in claim 8 wherein the electrical contacts comprise male pins.

11. A connector as in claim 8 wherein the lead frame comprises a first end with connection sections attached to the electrical contacts, a second end forming a ground plane, and a middle section having the circuit elements.

12. A connector as in claim 11 wherein the middle section further comprises a bridging section formed by the bandolier directly connecting the ground plane to one of the contacts through one of the first end connection sections.

13. A connector as in claim 11 wherein the second end is electrically connected to an electrically conductive portion of the housing.

14. A connector as in claim 11 wherein two of the first end connection sections are directly connected to each other.

15. A method of manufacturing a circuit assembly comprising steps of:

connecting electrical contacts to a bandolier; and attaching electrical circuit elements directly on the bandolier;

wherein the bandolier forms a lead frame between the contacts and the circuit elements, and wherein the bandolier physically supports the contacts before the contacts are attached to a connector housing.

16. A method as in claim 15 further comprising cutting the bandolier after the circuit elements are attached to the bandolier.

17. A method as in claim 16 wherein the step of cutting comprises cutting out segments of the bandolier located directly under the circuit elements.

18. A method as in claim 16 wherein the step of cutting comprises cutting out bridging sections located laterally adjacent the circuit elements.

19. A method as in claim 15 wherein the circuit elements comprise chip capacitors surface mounted on the bandolier.

20. A method of manufacturing an electrical connector comprising steps of:

manufacturing a circuit assembly as in claim 15; and inserting the circuit assembly into a housing.

* * * * *